US008309620B2

(12) United States Patent
Fuqua

(10) Patent No.: US 8,309,620 B2
(45) **Date of Patent: *Nov. 13, 2012**

(54) LIGNITE-BASED URETHANE RESINS WITH ENHANCED SUSPENSION PROPERTIES AND FOUNDRY SAND BINDER PERFORMANCE

(75) Inventor: Joseph M. Fuqua, Fond du Lac, WI (US)

(73) Assignee: Amcol International Corp.

( * ) Notice: Subject to any disclaimer, the term of this patent is extended or adjusted under 35 U.S.C. 154(b) by 144 days.

This patent is subject to a terminal disclaimer.

(21) Appl. No.: 12/574,525

(22) Filed: Oct. 6, 2009

(65) Prior Publication Data

US 2011/0081270 A1 Apr. 7, 2011

(51) Int. Cl.
*C08G 18/14* (2006.01)

(52) U.S. Cl. ..... 521/101; 210/679

(58) Field of Classification Search ..... 44/551, 44/10; 523/139, 142; 521/101; 210/679
See application file for complete search history.

(56) References Cited

U.S. PATENT DOCUMENTS

| | | | | | |
|---|---|---|---|---|---|
| 3,023,113 | A | | 2/1962 | Barlow | |
| 3,083,118 | A | * | 3/1963 | Bridgeford | 428/375 |
| 3,330,686 | A | * | 7/1967 | Rose | 427/302 |
| 3,409,579 | A | | 11/1968 | Robins | |
| 3,429,848 | A | | 2/1969 | Robins | |
| 3,432,457 | A | | 3/1969 | Robins | |
| 3,445,251 | A | | 5/1969 | Nevins | |
| 3,676,392 | A | | 7/1972 | Robins | |
| 3,832,191 | A | | 8/1974 | Bolding et al. | |
| 3,862,080 | A | * | 1/1975 | Standen et al. | 523/142 |
| 3,925,296 | A | | 12/1975 | Stone et al. | |
| 4,311,631 | A | | 1/1982 | Myers et al. | |
| 4,359,339 | A | | 11/1982 | Van Fisk, Jr. | |
| 4,400,475 | A | | 8/1983 | Kennedy | |
| 4,417,998 | A | | 11/1983 | Kennedy | |
| 4,586,936 | A | * | 5/1986 | Schaffer et al. | 44/553 |
| 4,597,878 | A | | 7/1986 | House et al. | |
| 4,608,397 | A | * | 8/1986 | Reischl | 521/101 |
| 4,705,570 | A | | 11/1987 | Paul et al. | |
| 4,734,439 | A | * | 3/1988 | Reischl | 521/54 |
| 4,735,973 | A | | 4/1988 | Brander | |
| 4,801,621 | A | * | 1/1989 | Reischl | 521/53 |
| 4,851,457 | A | * | 7/1989 | Kurple | 523/142 |
| 4,855,052 | A | * | 8/1989 | Reischl | 210/632 |
| 5,244,473 | A | * | 9/1993 | Sardessai et al. | 44/553 |
| 5,376,696 | A | | 12/1994 | Dunnavant et al. | |
| 5,430,072 | A | | 7/1995 | Muller et al. | |
| 5,455,287 | A | | 10/1995 | Carpenter et al. | |
| 5,585,428 | A | * | 12/1996 | Quinn et al. | 524/400 |
| 5,611,853 | A | | 3/1997 | Morimoto | |
| 5,616,628 | A | * | 4/1997 | von Bonin et al. | 521/157 |
| 5,688,313 | A | | 11/1997 | Landis | |
| 5,695,554 | A | | 12/1997 | Landis | |
| 5,769,933 | A | | 6/1998 | Landis | |
| 5,810,918 | A | | 9/1998 | Landis | |
| 5,856,375 | A | | 1/1999 | Chang et al. | |
| 5,911,269 | A | | 6/1999 | Brander et al. | |
| 5,916,826 | A | * | 6/1999 | White | 44/551 |
| 6,005,021 | A | | 12/1999 | Chen et al. | |
| 6,136,888 | A | | 10/2000 | Torbus et al. | |
| 6,264,775 | B1 | | 7/2001 | Holeschovsky et al. | |
| 6,288,139 | B1 | | 9/2001 | Skoglund | |
| 6,291,550 | B1 | * | 9/2001 | Chen et al. | 523/142 |
| 6,506,223 | B2 | * | 1/2003 | White | 44/551 |
| 6,509,392 | B1 | | 1/2003 | Jhaveri et al. | |
| 6,554,049 | B2 | * | 4/2003 | Steele et al. | 164/5 |
| 6,559,203 | B2 | * | 5/2003 | Hutchings et al. | 523/142 |
| 6,719,835 | B2 | | 4/2004 | Brown | |
| 6,772,820 | B2 | | 8/2004 | Roze et al. | |
| 6,822,042 | B2 | | 11/2004 | Capps | |
| 6,834,706 | B2 | * | 12/2004 | Steele et al. | 164/5 |
| 6,846,849 | B2 | | 1/2005 | Capps | |
| 6,972,302 | B2 | | 12/2005 | Baker et al. | |
| 7,871,972 | B2 | | 1/2011 | SenGupta | |
| 2004/0039235 | A1 | | 2/2004 | Bergstrom et al. | |
| 2005/0017394 | A1 | | 1/2005 | Hochsmann et al. | |
| 2007/0281876 | A1 | | 12/2007 | Garner et al. | |
| 2008/0277351 | A1 | | 11/2008 | Harman et al. | |
| 2009/0162408 | A1 | | 6/2009 | SenGupta | |
| 2009/0314461 | A1 | | 12/2009 | Attridge et al. | |
| 2010/0319874 | A1 | | 12/2010 | Thiel et al. | |
| 2011/0019044 | A1 | | 1/2011 | Wang et al. | |

(Continued)

FOREIGN PATENT DOCUMENTS

| | | |
|---|---|---|
| CA | 0 843 443 | 6/1970 |

(Continued)

OTHER PUBLICATIONS

"What's in Product Data Base" (Consumer Product Information Database), pp. 167 (2001). URL:http://whatsinproducts.com/search_database_results.php.

Greene et al., Protective Groups in Organic Synthesis, John Wily & Sons (1999).

Jhurry et al., "Sucrose-Based Polymers: Polyurethanes with Sucrose in the Main Chain," *Eur. Polym. J.* , 33:1577-1582 (1997).

Visser et al., "Observations on the Dispersion and Aggregation of Clays by Humic Substances, I. Dispersive Effects of Humic Acids," *Geoderma*, 42(3-4):331-337 (1988). Abstract Only.

(Continued)

*Primary Examiner* — James J Seidleck

*Assistant Examiner* — Peter A Salamon

(74) *Attorney, Agent, or Firm* — Marshall, Gerstein & Borun LLP

(57) ABSTRACT

Described herein, in the preferred embodiment, is a leonardite-based polyurethane resin binder that may be used, among other applications, as a binder in combination with foundry aggregate, e.g., sand, for molding or casting metal parts. The binders described herein comprise a humic substance, preferably leonardite, combined with a polymerizable isocyanate, a polymerizable polyol, and a polymerization catalyst to make a polyurethane resin binder in situ in a foundry aggregate, such as sand.

20 Claims, No Drawings

U.S. PATENT DOCUMENTS

| | | | |
|---|---|---|---|
| 2011/0079366 | A1 | 4/2011 | Fuqua et al. |
| 2011/0081270 | A1 | 4/2011 | Fuqua |
| 2011/0082233 | A1 | 4/2011 | SenGupta et al. |

FOREIGN PATENT DOCUMENTS

| | | | | |
|---|---|---|---|---|
| EP | 0 361 447 | A2 | | 4/1990 |
| WO | WO-02/28937 | A2 | | 4/2002 |
| WO | WO-2009/065015 | A1 | | 5/2009 |
| WO | WO-2009/065018 | A1 | | 5/2009 |
| WO | WO 2009065015 | A1 | * | 5/2009 |
| WO | WO 2009065018 | A1 | * | 5/2009 |
| WO | WO-2009/126960 | A2 | | 10/2009 |
| WO | WO-2009/155242 | A1 | | 12/2009 |
| WO | WO-2011/044003 | A2 | | 4/2011 |
| WO | WO-2011/044004 | A2 | | 4/2011 |
| WO | WO-2011/044005 | A1 | | 4/2011 |

OTHER PUBLICATIONS

International Search Report and Written Opinion for Application No. PCT/US2010/051251, dated Oct. 7, 2011.

International Search Report and Written Opinion for Application No. PCT/US2010/051253, dated Oct. 7, 2011.

International Search Report and Written Opinion for Application No. PCT/US2010/051254, dated Feb. 16, 2011.

International Preliminary Report on Patentability for Application No. PCT/US2010/051254, dated Aug. 2, 2011.

Monroe, Use of iron oxide in mold and core mixes for ferrous castings, AFS Transactions, 93: 355-364 (1985).

International search report and written opinion for International Application No. PCT/US12/33861, mailing date Jul. 17, 2012.

* cited by examiner

LIGNITE-BASED URETHANE RESINS WITH ENHANCED SUSPENSION PROPERTIES AND FOUNDRY SAND BINDER PERFORMANCE

CROSS-REFERENCE TO RELATED APPLICATIONS

This application is related to and filed concurrent with copending U.S. patent application Ser. Nos. 12/574,475, 12/574,501 and 12/574,546.

TECHNICAL FIELD

This invention relates to polymerizable resin binders, particularly useful as foundry binders, processes for making foundry shapes by curing the binders in place after forming a foundry mold or core, foundry mixes and multi-part resin binder components or kits that are mixed on site to bind foundry aggregate, such as sand, in a desired shape.

BACKGROUND AND PRIOR ART

In the foundry art, sand casting is used to make metal parts. In sand casting, foundry shapes called molds, exterior casting forms, and cores, interior casting forms, are made from a mixture of a foundry aggregate, such as sand, and a binder. The two categories of sand molds are "green" and "rigid." Green sand molds are bonded with clay and water. Rigid sand molds are bonded with organic resins and can be hardened using one of several methods, including baking, curing with a chemical reagent, and flushing with a reactive gas. Molten metal is poured into and around the foundry shapes after they have hardened. The binders, e.g., phenol formaldehyde resins, or phenol-isocyanate (polyurethane) resins, used to form foundry shapes typically contain a significant amount of organic solvent, which can emit noxious fumes, as well as free reactants, e.g., formaldehyde or isocyanate and free phenol, that are detrimental to the cast metal and the foundry environment.

A urethane binder resin, when used in combination with a foundry aggregate such as sand, typically has three parts: a polymerizable polyol component, an isocyanate component, and a catalyst component. The polymerizable polyol compound, e.g., a polyol, such as ethylene glycol, and isocyanate react to form a cross-linked polymer which increases the tensile strength and/or hardness of the sand/binder mixture. The catalyst prompts the polymerizable components of the binder to polymerize, allowing for rapid conversion of the foundry mix into a hard and solid cured state suitable for forming shapes from molten metal poured therein.

Humic substances containing a plurality of hydroxyl groups have been asserted to represent an alternative reactant to the conventional phenol reactant for reactions with isocyanates in the formation of binder resins (see WO 2009/065018 A1). Humic substances include humic acid, fulvic acid, hymatomelanic acid, ulmic acid, and humin. As stated in WO 2009/065018 A1, humic substances contain hydroxyl groups that react with an isocyanate to form polyurethane resins. Humic acid has previously been included in foundry sand compositions. See U.S. Pat. Nos. 3,023,113 and 3,832,191. Humic acid can be derived from several sources, including lignite, leonardite, peat, and manure. Lignite and leonardite are preferred sources because they are rich in humic acid and readily mined. Lignite is an organic mineraloid that is the lowest rank of coal. Known as "brown coal," lignite has a high inherent moisture content of up to 66 wt. % and a high ash content compared to other forms of coal. Lignite has previously been used as an additive in foundry sand compositions comprising an additional binding agent such as bentonite clay. See U.S. Pat. Nos. 3,445,251 and 4,359,339. When lignite becomes highly oxidized, leonardite is formed. Oxidation increases the humic acid and carbonyl group content. Leonardite particles are generally anionically charged and composed primarily of the mixed salts of humic acid, ulmic acid, and fulvic acid. The humic acid in leonardite is soluble in alkaline solutions and can be extracted from a solid phase source using a strong base, such as sodium hydroxide or potassium hydroxide.

A humic substance containing composition, for use as a polyol component in urethane resin for use as a foundry sand binder is described in WO 2009/065018 A1. This prior art composition was found to have a short shelf life, with the composition showing gross separation (settling) of humic solids, and/or turning into a stiff (i.e. no fluidity) gel within a short duration of storage. The separation of the humic solid prevents the ready standardization of the addition of the humic solids to foundry aggregate over the course of normal foundry mold and core production. These variations in the composition of the foundry mix can affect casting performance of the foundry shape thereby impacting the cost and quality of the resultant casting in a negative manner. To provide a consistent and repeatable amount of humic solids to the foundry mix, the humic solids are herein provided in a stable liquid form. The multi-component kits described herein include a lignite-isocyanate suspension that contains a lignite, an isocyanate, a stabilization agent. Unlike reported lignite-polyol examples, lignite-isocyanate suspensions described herein are stable against separation of suspended solids. Furthermore, the addition of the stabilization agent would be expected to impair the performance of the foundry mix; however, the resin compositions surprisingly have been found to have improved binder performance compared to the binders of the prior art.

SUMMARY

Described herein, in the preferred embodiment, is a lignite-containing polyurethane resin binder that may be used, among other applications, as a binder of foundry aggregate, e.g., sand, for producing molds and cores for metal castings. The herein described kit can be used to make foundry molds and cores using the separate components of (a) a lignite, a polymerizable isocyanate, a stabilization agent; (b) a polymerizable polyol; and (c) a catalyst. The components (a), (b), and (c) are, preferably, separately stored. In another preferred embodiment, the components are admixed with a foundry aggregate to form a foundry mix which can be pressed or molded into a foundry shape.

DETAILED DESCRIPTION

Foundry shapes can be formed from foundry mix, e.g., from stable lignite-isocyanate suspensions by the in situ reaction of the isocyanate with a polymerizable polyol, admixed with a foundry aggregate. In a preferred embodiment, a stable lignite-isocyanate suspension, a polymerizable polyol, and a polyurethane polymerization catalyst are provided as a multi-component kit for admixing with a foundry aggregate, to form a foundry mix. The formation of the foundry mix typically involves the stepwise addition of the kit components to the foundry aggregate, e.g. sand, with mixing, to form a foundry mix that sets over the course of a predetermined time, typically minutes. The admixing of the kit components can be either stepwise in the foundry aggregate or some of the kit components, e.g., the polyol component and/or the catalysts component, can be admixed prior to admixing with the foundry aggregate. The kit components form a lignite-polyurethane resin that binds the foundry aggregate and permits the formation of a foundry shape useful in metal casting. Another aspect of the multi-component kit described herein is to provide foundry mixes utilizing the binder components.

The multi-component kits perform exceptionally well as binders in sand castings. Finished metal castings were produced from molds formed to a desired shape with the multi-component kits admixed with the foundry aggregate, as described in further detail below. Compared to conventional phenol-formaldehyde and phenol-isocyanate resin binders, the herein described foundry shapes made from the herein described multi-component kits, possess three significant benefits: 1) superior sand shakeout and better core burn out; 2) non-noxious smoke at during pouring, cooling, and shakeout; and 3) very low odor at mixing. Moreover, the herein described foundry shapes exhibit limited thermal shock and subsequently have a very high hot strength making them superior molds for metal casting. The quality of shakeout is an important consideration because aggregate and binder residue on the finished casting can impair the quality and/or performance of the finished casting.

The multi-component kits described herein comprise an organic solid having an insoluble component that is completely combustible. In this instance, insoluble means that one of ordinary skill using solvents typical of the art cannot fully solvate the organic solid and completely combustible means that the high temperature pyrolysis of the organic solid leaves little to no inorganic residue. Preferably, the organic solid is humic organic matter, wherein humic organic matter is a catchall term for biopolymers occurring in soil, sediment, and water. Typically, the humic organic matter is a humic substance, e.g. a humic acid-containing or humic acid salt-containing ore. More preferably, the humic organic matter is a lignite, even more preferably leonardite, previously described in this Assignee's U.S. Pat. Nos. 5,695,554 and 5,688,313, and hereby incorporated by reference.

Another important aspect of the multi-component kit is the stability of the kit over time. The separation of the lignite solids (particles) from the lignite-isocyanate suspension after preparation would be detrimental to the transport, storage, and utility of the suspension. Herein, the described lignite-isocyanate suspensions are stable over a sufficient time to allow remote manufacturing of the suspension, and subsequent transport, storage, and use without reagitation of the suspension.

The lignite-isocyanate suspension is an admixture of a lignite, a polymerizable isocyanate, and optionally a stabilization agent. Preferably the lignite-isocyanate suspension has good stability against separation; low-shear viscosity and shear-thinning rheology, e.g., wherein the viscosity of the suspension decreased by about 50% when the shear rate is increased from about 0.5 rpm to about 100 rpm; and good performance in urethane polymerization. As used herein, the lignite-isocyanate admixture is termed a suspension, this is used in a broad sense; the suspension can be a homogeneous mixture, a heterogeneous mixture, an emulsion, and the like.

Here, the lignite-isocyanate suspension is shear thinning. As used herein, shear thinning means the viscosity of the lignite-isocyanate suspension decreases with increasing shear force. The effect of shear thinning can be observed by measuring the viscosity of the suspension at various shear rates. The specific viscosity of individual lignite-isocyanate suspensions are dependant on the numerous factors, including the concentration of the components in the suspension, the lignite average particle size, and the chemical structure of the isocyanate. Preferably, the viscosity of the lignite-isocyanate suspension decreases by at least 50% when the shear rate is increased from about 5 rpm to about 100 rpm, as measured with a Brookfield Viscometer.

The humic substance is preferably a lignite, preferably leonardite, as previously described in this Assignee's U.S. Pat. Nos. 5,695,554 and 5,688,313, and hereby incorporated by reference. Preferably, the humic substance is a solid lignite component, that contains no more than about 35% water, more preferably about 0 wt. % to about 20 wt. % water, even more preferably about 0 wt. % to about 10 wt. %, and still more preferably about 0 wt. % to about 5 wt. %, based on the dry weight of the lignite. More preferably, the lignite component is leonardite and incorporated into the foundry mix at a concentration from about 1 to about 70 wt. % of the binder in the final foundry mix, more preferably from about 5 to about 50 wt. %, and even more preferably from about 10 to about 30 wt. %. The concentrations are based on the total dry weight of lignite and the total weight of added, active polymerizable polyol and isocyanate. The mean particle size of the leonardite is preferably from about 50 nm to about 500 μm, more preferably from about 500 nm to about 400 μm, even more preferably from about 5 μm to about 300 μm, and still more preferably from about 50 μm to about 200 μm.

The isocyanate component is preferably a polyisocyanate, for example a diisocyanate, a triisocyanate, and so on. The isocyanate component can be either a small molecule isocyanate, a polymeric isocyanate, or a blend of a plurality of isocyanates. Suitable isocyanates include p-phenylene diisocyanate (CAS No. 104-49-4), toluene diisocyanate (CAS No. 1321-38-6), 4,4'-methylenebis(phenylisocyanate) (CAS No. 101-68-8), polymethylene polyphenyl isocyanate (CAS No. 9016-87-9), 1,5-naphthalene diisocyanate (CAS No. 3173-72-6), bitolylene diisocyanate (CAS No. 91-97-4), m-xylene diisocyanate (CAS No. 3634-83-1), m-tetramethylxylene diisocyanate (CAS No. 58067-42-8), hexamethylene diisocyanate, (CAS No. 4098-71-9), 1,6-diisocyanato-2,2,4,4-tetramethylhexane (CAS No. 83748-30-5), 1,6-diisocyanato-2,4,4-trimethylhexane (CAS No. 15646-96-5), trans-cyclohexane-1,4-diisocyanate (CAS No. 2556-36-7), 1,3-bis (isocyanatomethyl)cyclohexane (CAS No. 38661-72-2), 3-isocyanato-methyl-3,5,5-trimethylcyclohexyl isocyanate (CAS No. 4098-71-9), dicyclohexylmethane diisocyanate (CAS No. 5124-30-1) and the polymeric 4,4'-methylene bis (phenyl)socyanates) available under the MONDUR product line from BAYER MATERIALSCIENCE. Preferably, the isocyanate component is the "Mondur MR" product available from BAYER MATERIALSCIENCE.

The stabilization agent should prevent or retard the separation of the organic solids from the isocyanate. Preferably, the stabilization agent is an urethane compatible polymer. More preferably, the stabilization agent is a thickening agent, even more preferably the stabilization agent has two components, a dispersing agent and a thickening agent.

Suitable dispersing agents include homopolymers and copolymers selected from the group consisting of polyethylene glycol/poly(oxyethylene) (PEG), polypropylene glycol, poly(acrylic acid) (PAA), poly(methacrylic acid) (PMA), poly(vinyl alcohol) (PVA), poly(acrylamide), poly(ethylene imine), poly(diallyldimethyl ammonium halide), and poly (vinyl methyl ether). Preferably, the weight average molecular weight of the dispersing agent is in the range of about 1,000 to about 60,000 Dalton, more preferably about 2,000 to about 30,000 Dalton, and most preferably about 4,000 to about 10,000 Dalton. Preferably, the dispersing agent is a monoesterified, homo- or co-polymer of polyethylene glycol (PEG).

Commercial PEG polymers are generally labeled as either PEG-n or PEG M, where (n) refers to the average number of ether oxygen groups or the ethylene oxide (EO) repeat units, and the letter (M) refers to an average molecular weight of the polymer. For example, a PEG with n=150 would have an average molecular weight of about 6,000 Dalton and would be labeled as either PEG-150 or PEG 6000. For consistency herein, the PEG polymers are referred to by the average number of EO repeat units per polymer chain and one of ordinary skill in the art can convert one denotation to another.

Herein, the preferred PEGs are those PEGs in the range of PEG-25 to PEG-1400, more preferably in the range of PEG-45 to PEG-700, even more preferably in the range of PEG-90 to PEG-225, and still more preferably PEG-100, PEG-125, and PEG-150. Herein, the preferred dispersing agents are monoesterified where the ester functionality has a linear, branched, cyclic and/or aromatic group. Preferably, the ester functionality is a linear or branched alkyl group with an alkyl chain length equal to or greater than about 8 ($C_8$). More preferably the alkyl chain length is about $C_8$-$C_{18}$, still more preferably the alkyl chain is stearate. Three non-limiting examples of dispersing agents that correspond to the above recited preferences are PEG-100 monostrearate, PEG-125 monostearate, and PEG-150 monostrearate.

Copolymer dispersing agents include those polymers made from two or more different monomers. The preferable monomers include propylene oxide, vinyl acetate, vinyl amine, vinyl chloride, acrylamide, acrylonitrile, ethylene, propylene, ethylene oxide, lauryl methacrylate, methyl methacrylate, hydroxystearate, dimethylsiloxane, diallyldimethyl ammonium halide, ethylenimine, acrylic acid, and methacrylic acid. Preferably, one of the monomers is ethylene oxide. More preferably, the mole-fraction of the comonomer to ethylene oxide in the dispersing agent is preferably $\leqq 0.4$, more preferably $\leqq 0.3$, and even more preferably $\leqq 0.2$.

Yet another class of polymer applicable as a dispersing agent includes polyvinylpyrrolidone (PVP) polymers and copolymers. Notably, PVP dispersing agents have, preferably, a higher weight average molecular weight than the PEG dispersing agents. Preferably, the weight average molecular weight of the PVP dispersing agent is in the range of about 1,000 to about 1,000,000 Dalton, more preferably about 4,000 to about 500,000 Dalton, and most preferably about 10,000 to about 100,000 Dalton. For example, one preferred PVP homopolymer dispersing agent has a weight average molecular weight of 60,000 Dalton, e.g., (PVP K-30; CAS No. 9003-39-8). Similar to the above disclosed PEG dispersing agents, PVP dispersing agents can be copolymers, including block and graft copolymers, of pyrrolidone and vinyl acetate, vinyl amine, lauryl methacrylate, methyl methacrylate, acrylic acid, methacrylic acid, hydroxystearate, dimethylsiloxane, diallyldimethyl ammonium halide, and/or ethylenimine.

Preferably, the dispersing agent is incorporated into the lignite-isocyanate suspension in a concentration of about 0.1 to about 30 wt. %, more preferably about 0.25 to about 20 wt. %, even more preferably about 0.5 to about 15 wt. %, based on the weight of the lignite in the suspension.

Suitable thickening agents include homopolymers and copolymers selected from the group consisting of polyethylene glycol/poly(oxyethylene) (PEG), poly(acrylic acid) (PAA), poly(methacrylic acid) (PMA), poly(vinyl alcohol) (PVA), poly(acrylamide), poly(ethylene imine), poly(diallyldimethyl ammonium halide), and poly(vinyl methyl ether); gelatins, and polysaccharides. Preferably, the weight average molecular weight of a PEG-based thickening agent is in the range of about 1,000 to about 60,000 Dalton, more preferably about 2,000 to about 30,000 Dalton, and most preferably about 4,000 to about 10,000 Dalton. The weight average molecular weight of non-PEG-based thickening agents can be up to about 5,000,000 Dalton. Preferably, the thickening agent is a non-esterified or a diesterified, homo- or co-polymer of polyethylene glycol (PEG). Herein, the preferred PEGs are those PEGs in the range of PEG-25 to PEG-1400, more preferably in the range of PEG-45 to PEG-700, even more preferably in the range of PEG-90 to PEG-225, and still more preferably PEG-100, PEG-125, and PEG-150. Herein, the preferred thickening agents are non-esterified or diesterified ester, where the ester functionality has a linear, branched, cyclic and/or aromatic group. Preferably, the ester functionality is a linear or branched alkyl group with a alkyl chain length equal to or greater than about 8 ($C_8$). More preferably the alkyl chain length is about $C_8$-$C_{18}$, still more preferably the alkyl chain is stearate. Six non-limiting examples of thickening agents that correspond to the above recited preferences are PEG-100, PEG-125, PEG-150, PEG-100 distrearate, PEG-125 distrearate, and PEG-150 distrearate. Other preferably thickening-agents include glyceryl esters, having a weight average molecular weight in the range of about 1,000 to about 15,000 Dalton, more preferably about 2,000 to about 10,000 Dalton, and most preferably about 4,000 to about 7,000 Dalton.

Preferably, the thickening agent is incorporated into the lignite-isocyanate suspension in a concentration of about 0.05 to about 10 wt. %, more preferably about 0.1 to about 7.5 wt. %, even more preferably about 0.2 to about 5 wt. %, based on the weight of the suspension.

Suitable polymerizable polyols include, but are not limited to, glycols and glycerols. Glycols include those linear glycols that have a molecular formula of $HO—(CH_2CH_2O)_x—H$, where x is a value between 1 and about 25; and the branched polyols that have a molecular formula of $HO—(CH_2CH_2(R)O)_x—H$, where x is a value between 1 and about 25, and R is a linear, branched, cyclic, alkyl, and/or aromatic group that optionally includes one or more pnictide, chacogenide, and/or halide-containing functionalities. One preferred class of the branched polyols are the glycerols, wherein R contains an alcohol functionality. Suitable polyols additionally include mixed glycols and mixed glycerols. An illustrative example of a mixed glycol is a hydroxy-ethyleneglycol-p-xylene ($HOCH_2C_6H_4CH_2OCH_2CH_2OH$). Preferably, the polymerizable polyol is a linear glycol having a molecular formula wherein x is a value between 1 and about 10, more preferably wherein x is between 1 and about 5, and even more preferably 3, wherein the glycol is triethylene glycol.

Catalyst components for making rigid polyurethane materials include tin and tertiary amine catalysts. Preferably, the catalyst component favors the gelation reaction (urethane formation) over the blowing reaction (urea formation), as understood in the art. A non-limiting list of applicable catalysts include 1,4-diazabicyclo[2.2.2]octane (DABCO), 1,5-diazabicyclo[4.3.0]non-5-ene (DBN), 1,8-diazabicyclo[5.4.0]undec-7-ene (DBU), pentamethyldipropylenetriamine, bis(dimethylamino ethyl) ether, pentamethyldiethylenetriamine, dimethylcyclohexylamine, tris (3-dimethylamino) propylamine, and other liquid tertiary amines. Preferably, the catalyst component is tris (3-dimethylamino) propylamine.

A preferred process for preparing the lignite-isocyanate suspension described herein comprises: 1) heating a mixture of an isocyanate and a dispersing agent to 70° C. in a suitable vessel; 2) mixing the isocyanate with lignite in a high-shear mixer at 70° C.; 3) adding a molten thickening agent; and 4) cooling the batch under agitation to ambient temperature. In a preferred embodiment, the dispersing agent is PEG-100 stearate at a concentration of about 0.1 to 25 wt. % based on the total weight of the lignite, dry basis, more preferably about 0.5 to about 5 wt. %. The isocyanate is incorporated at a concentration of about 15 to about 90 wt. %, based on the total final weight of the lignite-isocyanate suspension, more preferably about 40 to about 70 wt. %. The thickening agent is preferably a waxy compound, e.g. PEG-150 distearate, at a concentration of about 0.1 to about 10 wt. %, based on the total weight of the lignite-isocyanate suspension, more preferably of about 0.5 to about 4 wt. %.

The type of aggregate and amount of binder used to prepare foundry mixes can vary widely and is known to those skilled in the art. One preferred aggregate is silica sand. Other suitable aggregate materials include olivine, zircon, chromite, carbon, fluid coke, related materials, and aggregate mixtures.

The multi-component kits are preferably used as binders in combination with foundry aggregate at concentrations at about 0.1 to about 10 wt. %, more preferably at about 1 to about 2.5 wt. %, based on the dry weight of the aggregate.

In one preferred embodiment for preparing a foundry shape, the components of the multi-component kits are individually admixed with the foundry aggregate. The resultant foundry mix is then mixed until nearly homogeneous, and then formed into a foundry shape. In another preferred embodiment the lignite-isocyanate suspension and the polyol components are premixed, then admixed with the foundry aggregate. In yet another embodiment, the lignite-isocyanate suspension is premixed with the catalyst component, then admixed with the foundry aggregate. In still another embodiment, the polyol is premixed with the catalyst component and then admixed with the foundry aggregate.

The foundry mix is then formed into a foundry shape. Generally in the art, the mold and the core are made from different foundry mixes. The mold mix commonly comprising a clay binder and the core mix commonly comprising a polymer binder. After casting, the majority of the spent foundry shape is removed from the cast shape by shake-out. During shake-out the majority of the mold breaks free from the casting and some of the core is removed. Often the core-binders are not destroyed during casting and must be physically broken from the internal areas of the core. Following the shake-out process and core-removal, the casting is cleaned, wherein residual aggregate is removed by primarily shot blasting. Here, metal flashing and aggregate is removed from the surface of the casting and metal is often adhered to the aggregate. This multi-step process for isolating a metal casting is time consuming, costly, as well as energy and material intensive. The herein described materials and methods significantly reduce the time and energy necessary for the isolation of a metal casting by improving the shake-out, the core removal process, and the number of foundry mixes necessary to make a foundry shape. Preferably, the mold and the core are manufactured with the herein described foundry mix and after casting are cleanly broken from the metal casting during shake-out.

In a preferred embodiment the core is manufactured from the herein described foundry mix. Preferably, the binders in the core shape are fully destroyed by the heat of the liquid metal and following the solidification of the metal flow freely from the core area during shakeout. More preferably, about 30 to about 60% more aggregate is removed during shake-out when the herein described foundry mix is used to form the foundry shape. Even more preferably and possibly due to improved burn-out of the binder, the reclamation costs for the aggregate are decreased by about 20 to about 50%.

The metal casting (an article of manufacture) is preferably formed by pouring liquid metal into the foundry shape. The metal making up the casting and/or the liquid can be any metal capable of being cast in an aggregate shape. Examples of metals include iron, steels, carbon steals, stainless steels, chromium steels, alloys, aluminum, titanium, zinc, copper, silver, gold, platinum, palladium, nickel, cobalt, manganese, and mixtures thereof. Preferably, the liquid metal is poured at a sufficiently high temperature to facilitate the burnout of the core resin.

The compositions and processes described herein have been primarily described and illustrated in terms of their use in the foundry art, but those skilled in the art will recognize that the binder resins and binder resin-containing compositions described herein may also be utilized in other fields, including adhesives, coatings, and composites.

Example

General Procedure: Leonardite was milled so that 100% of the leonardite passed a 200 mesh screen (74 micron). The milled leonardite was then dried so that the residual moisture content, as determine by a moisture teller, was less than 1 wt. %. Separately, the indicated quantity of isocyante was mixed with a high shear, rotor stator homogenizer (Silverson Homogenizer). A quantity of dried, milled leonardite was incrementally to the isocyanate over about four minutes and the suspension was continuously mixed at 6,000 rpm for about 20 minutes.

The stability of the lignite-isocyanate suspension without the addition of a thickening agent, the sample, was tested allowing the sample to sit, undisturbed, for at least 24 hours. A small laboratory spatula was then inserted into the sample and the bottom of the beaker was scraped. If settled material was readily apparent, e.g. the supernatant appears clear and the bottom of the beaker is thickly coated with solid, the solid adheres to the spatula upon removal from the suspension, and/or the spatula encounters increased resistance across the bottom of the beaker, then the sample is determined to have failed this test. Correspondingly, the sample passes the test if there is no observable material and/or no material adhering to the spatula. Additionally, samples were allowed to sit, undisturbed for seven days and tested for settled solids, as outlined above. The compositions of the samples and the results of the static settling test are presented in Table 1.

Table 1 additional shows observations from the mixing of the lignite and the isocyanate. One of ordinary skill in the art would recognize that the reaction of an isocyanate with an alcohol is an exothermic reaction and that the lack of an exotherm is indicative of little to no reaction between a reagent and an isocyanate.

TABLE 1

| Experiment Number | Weight of Leonardite | Moisture Content of Leonardite | Weight of Isocyanate | Settled Solids Detected After 24 Hours | Settled Solids Detected After 7 Days | Exothermic Reaction Detected Immediately |
|---|---|---|---|---|---|---|
| 1 | 10 g | <1% | 50 g | No | No | No |
| 2 | 20 g | <1% | 50 g | No | No | No |
| 3 | 30 g | <1% | 50 g | No | No | No |
| 4 | 50 g | <1% | 50 g | No | No | No |
| 5 | 100 g | <1% | 50 g | No | No | No |

1) Leonardite was AGRO-LIG from AMERICAN COLLOID Co. subsequently dried to less than 1% moisture content.
2) Isocyanate was MONDUR MR from BAYER MATERIALSCIENCE Co.

What is claimed is:

1. A lignite-isocyanate suspension comprising:

a lignite and an isocyanate; wherein the suspension is stable against separation for at least 24 hours, and the isocyanate group is about 15 weight percent (wt %) to about 90 wt % based on the total weight of the lignite-isocyanate suspension.

2. The suspension of claim 1 further comprising a stabilization agent.

3. A process of making a lignite-isocyanate suspension comprising:

admixing a lignite, an isocyanate, a dispersing agent, and a thickening agent at a temperature in a range of about 30 to about 150° C., wherein the isocyanate group is about 15 wt % to about 90 wt % based on the total weight of the lignite-isocyanate suspension.

4. A kit for binding an aggregate comprising:

a lignite-isocyanate suspension, and a polymerizable polyol;

wherein the lignite-isocyanate suspension comprises a lignite, a polymerizable isocyanate, a dispersing agent, and a thickening agent, and the isocyanate group is about 15 wt % to about 90 wt % based on the total weight of the lignite-isocyanate suspension, and the suspension is stable against separation for at least 24 hours.

5. A foundry mix comprising a lignite-polyurethane resin; and a foundry aggregate; wherein the lignite-polyurethane resin is manufactured from a lignite-isocyanate suspension and a polymerizable polyol; wherein the lignite-isocyanate suspension comprises about 15 wt % to about 90 wt % isocyanate group based on the total weight of the lignite-isocyanate suspension and lignite-isocyanate suspension is stable against separation for at least 24 hours.

6. An article of manufacture comprising: a metal casting;

wherein the metal casting is made by a process comprising pouring a liquid metal into a foundry shape;

wherein the foundry shape is made from a foundry mix;

wherein the foundry mix comprises a lignite-polyurethane resin and a foundry aggregate;

wherein the lignite-polyurethane resin is manufactured from a lignite-isocyanate suspension and a polymerizable polyol; and wherein the lignite-isocyanate suspension comprises 15 wt % to about 90 wt % isocyanate group based on the total weight of the lignite-isocyanate suspension and the lignite-isocyanate suspension stable against separation for at least 24 hours.

7. The lignite-isocyanate suspension of claim 1, wherein the lignite has a mean particle size in a range of about 50 nm to 500 μm.

8. The lignite-isocyanate suspension of claim 7, wherein the lignite has a mean particle size in the range of about 500 nm to about 400 μm.

9. The lignite-isocyanate suspension of claim 8, wherein the lignite has a mean particle size in the range of about 50 nm to about 200 μm.

10. The lignite-isocyanate suspension of claim 1, further comprising a dispersing agent selected from the group consisting of polyethylene glycol/poly(oxyethylene) (PEG), polypropylene glycol, poly(acrylic acid) (PAA), poly(methacrylic acid) (PMA), poly(acrylamide), poly(ethylene imine), poly(diallyldimethyl ammonium halide), and poly (vinyl methyl ether).

11. The suspension of claim 10 further comprising a thickening agent.

12. The suspension of claim 11 wherein the thickening agent is a homopolymer or copolymer selected from the group consisting of polyethylene glycol/poly(oxyethylene) (PEG), poly(acrylic acid) (PAA), poly(methacrylic acid) (PMA), poly(acrylamide), poly(ethylene imine), poly(diallyldimethyl ammonium halide), and poly(vinyl methyl ether); a gelatin, and a polysaccharide.

13. The suspension of claim 12, wherein the thickening agent is polyethylene glycol.

14. The suspension of claim 13, wherein the polyethylene glycol has a weight average molecular weight in the range of about 1,000 to about 60,000 Dalton.

15. The suspension of claim 14, wherein the polyethylene glycol has a weight average molecular weight in the range of about 2,000 to about 30,000 Dalton.

16. The suspension of claim 15, wherein the polyethylene glycol has a weight average molecular weight in the range of about 4,000 to about 10,000 Dalton.

17. The lignite-isocyanate suspension of claim 10, wherein the lignite has a mean particle size in a range of about 50 nm to 500 μm.

18. The lignite-isocyanate suspension of claim 17, wherein the lignite has a mean particle size in the range of about 500 nm to about 400 μm.

19. The lignite-isocyanate suspension of claim 17, wherein the lignite has a mean particle size in the range of about 50 nm to about 200 μm.

20. A process of making a lignite-isocyanate suspension comprising:

admixing a lignite and an isocyanate, wherein the suspension is stable against separation for at least 24 hours, and the isocyanate group is about 15 wt % to about 90 wt % based on the total weight of the lignite-isocyanate suspension.

* * * * *